US007344268B2

(12) United States Patent
Jigamian

(10) Patent No.: US 7,344,268 B2
(45) Date of Patent: Mar. 18, 2008

(54) LONG-RANGE, HANDHELD ILLUMINATION SYSTEM

(75) Inventor: Gregory Z. Jigamian, Temecula, CA (US)

(73) Assignee: Xenonics, Inc., Carlsbad, CA (US)

( * ) Notice: Subject to any disclaimer, the term of this patent is extended or adjusted under 35 U.S.C. 154(b) by 50 days.

(21) Appl. No.: 10/614,635

(22) Filed: Jul. 7, 2003

(65) Prior Publication Data

US 2005/0007766 A1 Jan. 13, 2005

(51) Int. Cl.
*F21L 4/00* (2006.01)
*F21V 29/00* (2006.01)

(52) U.S. Cl. ..... 362/202; 362/294; 362/373

(58) Field of Classification Search ..... 362/294, 362/373, 202, 203, 204, 205, 206, 207; 257/706, 257/720

See application file for complete search history.

(56) References Cited

U.S. PATENT DOCUMENTS 6,481,874 B2 * 11/2002 Petroski ..... 362/373
6,702,452 B2 * 3/2004 Jigamian et al. ..... 362/205
6,827,468 B2 * 12/2004 Galli ..... 362/294
6,866,401 B2 * 3/2005 Sommers et al. ..... 362/268
6,880,951 B2 * 4/2005 Yoon ..... 362/206
6,909,250 B2 * 6/2005 Jigamian et al. ..... 315/307
6,942,365 B2 * 9/2005 Galli ..... 362/294
2004/0130892 A1 * 7/2004 Galli ..... 362/187
2004/0190286 A1 * 9/2004 Chapman ..... 362/171

* cited by examiner

*Primary Examiner*—Thomas M. Sember
(74) *Attorney, Agent, or Firm*—Howard IP Law Group, PC

(57) ABSTRACT

A long-range, high intensity handheld searchlight has several novel features that improve existing designs. The invention minimizes electrical penetrations to the handheld searchlight by having a magnetic ON/OFF switch. A heat sink is disclosed that is in thermal contact with the external housing without physically penetrating the housing. Additionally, when an external power source in required, power transfer is achieved by inductive coupling to further eliminate electrical penetrations that affect watertight integrity. Also disclosed is a lamp socket assembly for a handheld searchlight that has springs that act as floating contacts within a lamp socket hole. The springs provide proper alignment for the lamp that is critical to achieve a high-intensity light beam. A lamp is disclosed that has its electrodes adjacent to one another for easy installation and removal of the lamp. A shoulder strap is further disclosed to facilitate transportation and use of a handheld searchlight.

12 Claims, 8 Drawing Sheets

LONG-RANGE, HANDHELD ILLUMINATION SYSTEM

BACKGROUND OF THE INVENTION

1. Field of the Invention

The invention relates generally to arc lamp illumination systems and more particularly to a high intensity, long-range, handheld searchlight.

2. Description of the Prior Art

Many nighttime operations, such as those performed military and law enforcement, depend on the latest advancements in illumination technology to attain the best possible advantage. Xenonics, Inc., an intended licensee/assignee of the present invention, is the world leader in compact, high intensity, height efficiency xenon short-arc lighting systems. Its products are not only used by military, and law enforcement but also entertainment and other professionals in various applications such as physical security, surveillance, crowd control, special effects and search and rescue operations. U.S. patent application Ser. No. 09/440,105, discloses a xenon arc illumination system with several features designed to increase lamp intensity. It includes circuitry that has power converters to generate the high voltages needed to ignite a plasma within a lamp. The circuitry also supplies power efficiently to maximize battery life. Additionally, the patent application discloses an apparatus wherein the lamp is positioned within a parabolic reflector so that that no un-illuminated area or "black hole" is produced when the beam is diffused in a flood pattern. The matter presented in the aforementioned patent application is hereby incorporated by reference in its entirety.

In light of the advancements desired in portable illumination systems, it is an object of the present invention to provide a handheld searchlight with optimum heat transfer characteristics to efficiently dissipate heat generated by the lamp and associated circuitry. It is another object of the present invention to provide a lamp socket assembly for a handheld searchlight that allows for proper alignment of the lamp within the socket assembly. It is yet another object of the present invention to provide a lamp for a handheld searchlight that is a single-ended design wherein the cathode and the anode connections are adjacent to one another. It is a further object of the present invention to provide a handheld searchlight with a shoulder strap designed to support the weight of the handheld searchlight while it is in use. It is another object of the invention to provide a handheld searchlight that is significantly lighter in weight than in previous designs. It is still another object of the present invention to provide a handheld searchlight external design that eliminates or significantly reduces electrical penetrations to its housing.

SUMMARY OF THE INVENTION

A handheld searchlight having a lamp for efficiently producing a high intensity beam of light comprises: a printed circuit board having circuitry to regulate and control power supplied to the lamp; a housing to contain the printed circuit board; and a heat sink coupled to the printed circuit board, the heat sink also coupled to the housing to dissipate heat generated by the printed circuit board. It is preferred that the heat sink and the housing are made from extruded aluminum material for optimum heat transfer characteristics.

The handheld searchlight further comprises a battery contained within the housing and electrically connected to the printed circuit board, wherein the battery supplies power to the handheld searchlight. The battery has electrical contacts located alternatively on the bottom or one of the elongated sides. When the electrical contacts are located on the side of the battery, they are sliding contacts to that they may slide relative to their connections. The battery can be recharged from a battery charger contained within the housing. The battery charger provides a voltage for charging the battery for either an AC or a DC source. The handheld searchlight itself, can alternatively be powered by the battery or an external AC or DC source.

The handheld searchlight of the present invention further has a lamp assembly system that comprises a removable lamp having electrical contacts as pin leads. The lamp assembly also has a lamp socket hole for receiving a pin lead. The lamp socket hole includes a spring assembly for securing the electrical pin lead while allowing lateral and circular movement of the lamp in an X-Y plane to provide proper alignment of the lamp while providing an electrical connection between the lamp and the lamp socket hole. The lamp is also secured within the lamp socket hole by a surrounding bulkhead. The bulkhead, however has openings in it to allow removal of the lamp from the lamp socket hole. Preferably, when a lamp is removed it is done with a lamp extraction tool that is designed to grip the lamp without contaminating the lamp's glass envelope. The lamp further has a lamp protector that prevents contamination of the glass envelope. Additionally, the lamp is a single-ended design where the electrical pin contacts (cathode and anode) are physically adjacent to one another. This design provides better support for the lamp, reduces its mechanical complexity, and provides for easier replacement capability for the end user in the field.

The handheld searchlight of the present invention also includes a magnetic switch on the body section wherein the position of the magnet controls ON/OFF power to the lamp. The magnetic switch reduces electrical penetrations which improves the watertight integrity. The handheld searchlight further has a threaded end cap coupled to the body section at an end thereof. The threaded end cap having circular electrical contacts, wherein the circular electrical contacts are configured to couple an external power source to circuitry within the battery. Preferably, the end cap is configured to receive power by inductive coupling so that no electrical penetration is needed to receive power from an external source.

The handheld searchlight of the present invention also includes a lens coupled to the reflector at an end thereof and a threaded bezel to secure the lens and the reflector. Further, the invention has a threaded optical lens filter connected to the threaded bezel to filter selected wavelengths of light emitted from the lamp and to protect the lens from physical damage. The handheld searchlight also includes a slip-on shoulder strap secured to the body section for supporting the handheld searchlight.

The invention is additionally a method of supplying power to a handheld searchlight that comprises inducing a voltage from an external power source using inductive coupling. The external power source can be alternatively AC or DC. An optional DC power source is a vehicular battery having a voltage approximately in the range of 11.5 to 36 volts DC. This embodiment the invention further includes an external DC to AC converter, wherein the external DC to AC converter converts DC to high frequency AC for inductive coupling.

In another embodiment of the invention a lamp has a cylindrical neck portion, and a reflector collar is disposed around the lamp cylindrical neck portion. The interface between the collar and the neck portion is close while allowing the collar to move axially with respect to the neck portion. Additionally, the neck portion is able to transfer heat generated by the lamp to the collar and the reflector. Further the head section encasing the reflector and the lamp is in thermal contact with the reflector to facilitate heat dissipation generated by the lamp. The close interface between the collar and the neck portion maintains the lamp aligned on the optical axis of the reflector when the collar moves axially with respect to the neck portion.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWING

The objects, advantages and features of the present invention will become more apparent to those skilled in the art from the following detailed description, when read in conjunction with the accompanying drawings, wherein.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

The present invention has been realized, in a particular embodiment, under the tradename NighthunterII™ by Xenonics, Inc. The NighthunterII™ has been described as the world's longest-range handheld illumination system that employs the same type of xenon lamp technology as described in U.S. patent application Ser. No. 09/440,105, Apparatus And Method for Operating A Portable Xenon Arc Search Light, that is hereby incorporated by reference in its entirety. The technology employed by the handheld searchlight delivers a uniform beam with a range in excess of three-quarters of a mile, without the "black hole" that obstructs the field of view in prior searchlights or flashlights.

Another significant advancement of handheld searchlight of the present invention is its light weight. This is primarily due to the successful manufacture and implementation of a 20-watt xenon arc lamp. Previous lamps of similar comparison have been typically over 50 watts. Consequently, a lighter battery pack and associated charging and lamp circuitry is employed by the invention. As a result, the Nighthunter™ of the present invention, weighs approximately 4.8 pounds, while prior art comparable devices weigh greater that ten pounds. Similarly, the battery-run time achieved by the invention is significantly improved compared to prior devices. In practice, the battery-run time of the invention is approximately greater than 90 minutes while recharge time is approximately less than 90 minutes. Also, the Nighthunter™ can be recharged from a vehicular battery or via an external AC/DC converter.

Figure 1A:
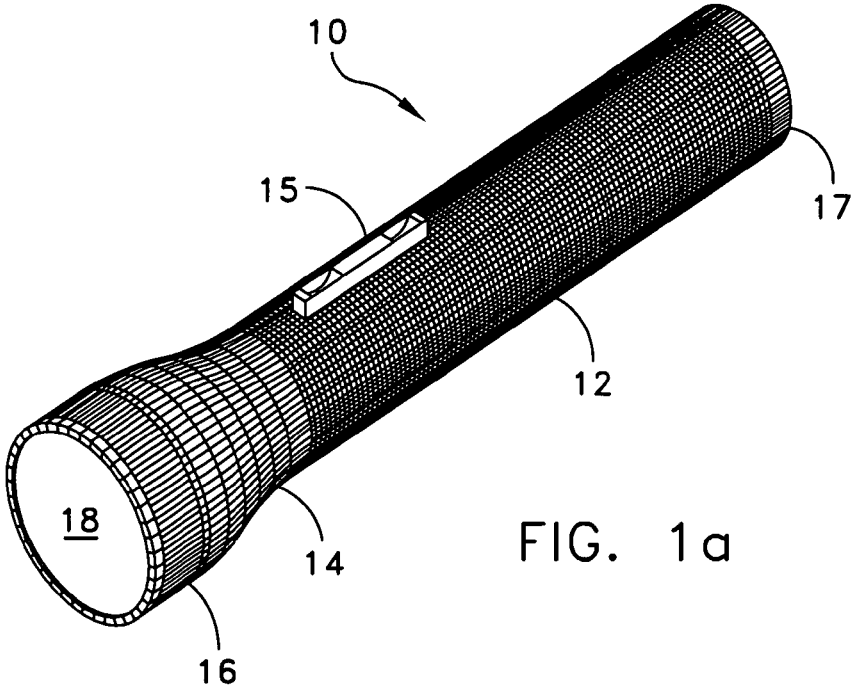
FIG. 1*a* is an isometric view of a handheld searchlight of the present invention.
Figure 1B:
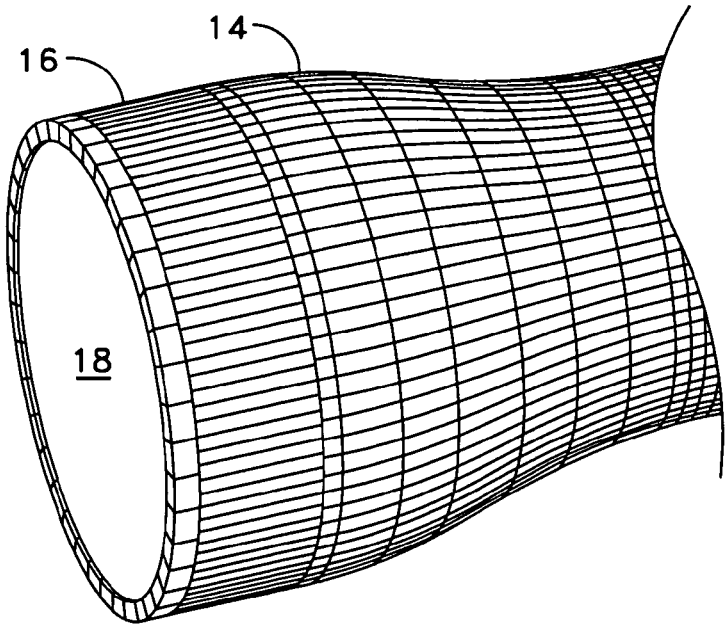
FIG. 1*b* is an enlarged isometric view of the head and filter sections of the present invention.

Referring initially to FIGS. 1*a* and 1*b*, the external housing configuration for a handheld searchlight 10 is shown. The components include a body 12, a head 14, a bezel 16, a lens protector/filter 18, and an end cap 17. Additionally, a magnetic switch 15 is provided. The switch 15 has an ON/OFF position corresponding to a position of the magnet that controls closure of a contact to start operation of the handheld searchlight 10. The magnetic switch 15 is preferred because it eliminates an electrical penetration to the housing that would otherwise be needed to improve watertight integrity. A further external feature is the knurl design of body 12 that provides a secure grip for the end user. This feature also enhances the ability to glue switch 15 part to body 12.

Figure 1C:
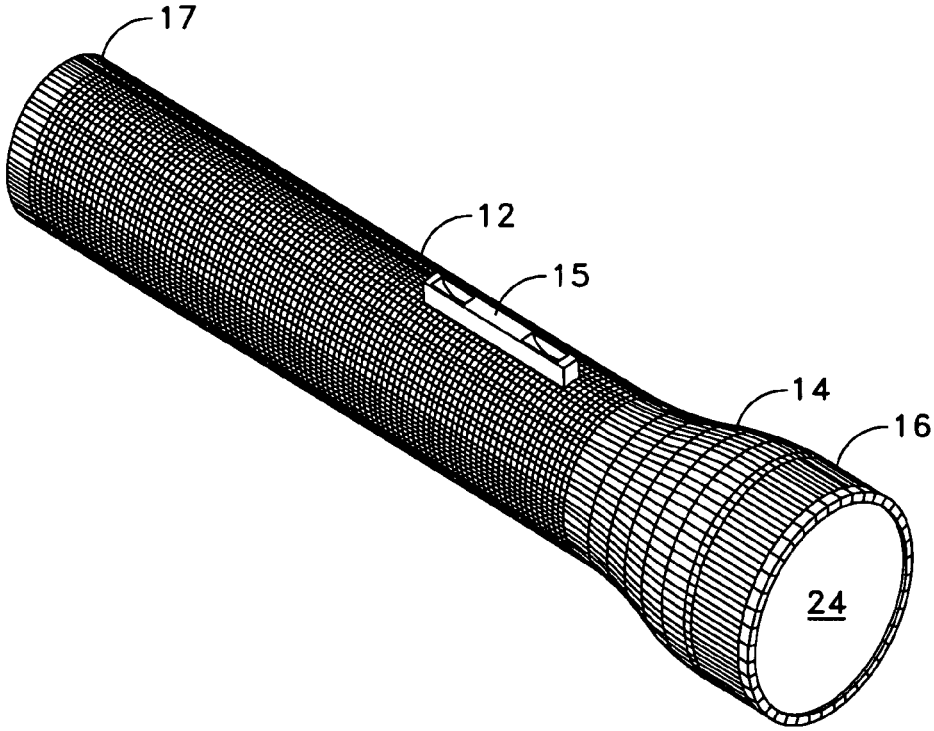
FIG. 1*c* is an isometric view of a handheld searchlight of the present invention with the filter section removed.

The filter 18 is an optional feature that may be an infrared filter, for example, that only permeates light having wavelengths of 850 nm and longer. The infrared filter 18 serves to boost the range of night vision illumination or may also be useful in low light video equipment applications. The filter 18, may alternatively be an ultraviolet filter to fluoresce objects for marking that can be achieved with the beam spread in low angle "spot" mode. Yet still, the filter 18 may alternatively be a simple piece of glass or transparent plastic material for added protection of the lens 24. It is contemplated that a wide variety of filters for many applications could be employed by the present invention. FIG. 1*c* is an illustration of the present invention showing a handheld searchlight 10 without a filter/lens protector of the present invention.

Figure 2:
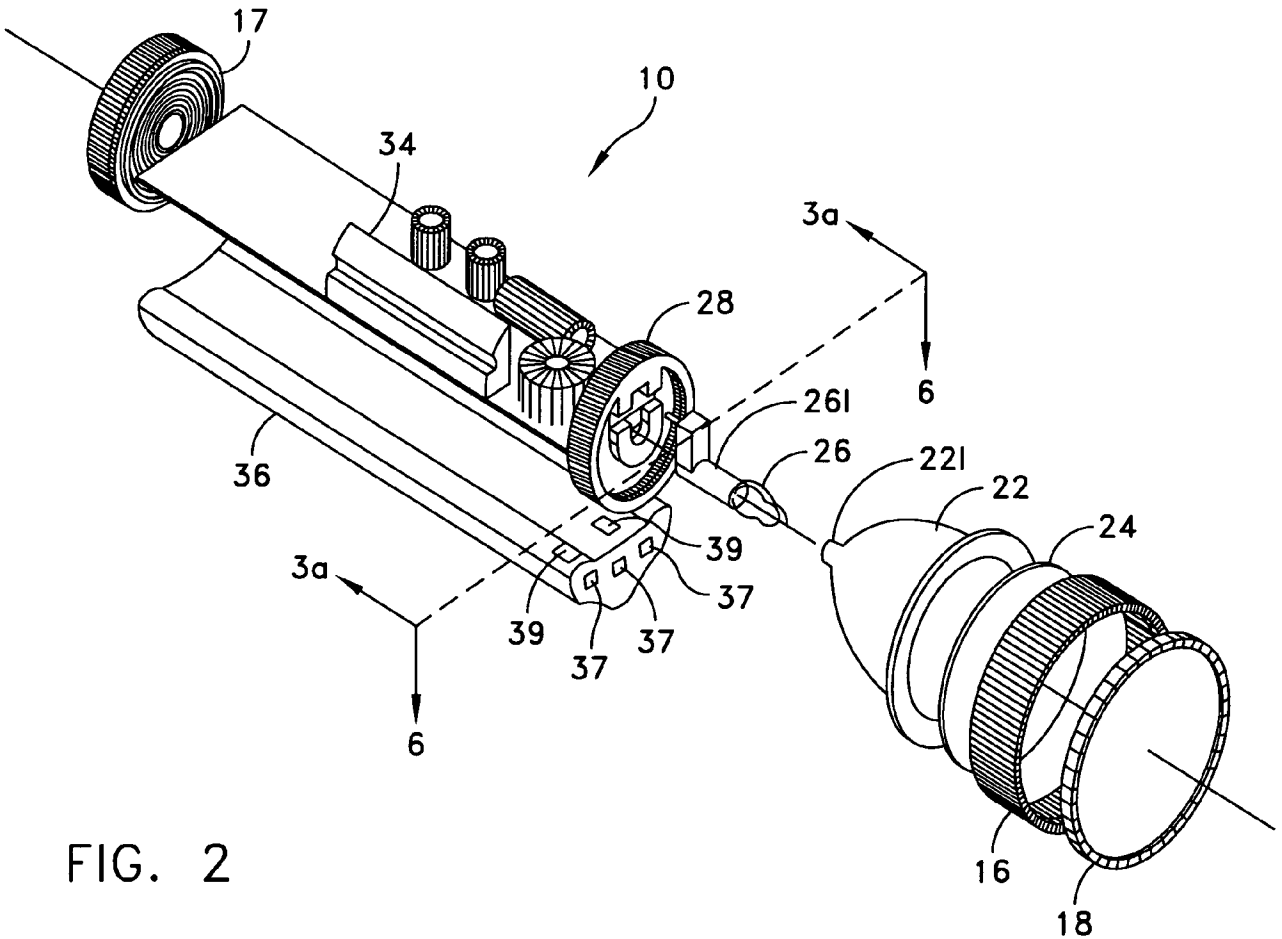
FIG. 2 is an isometric view of a handheld searchlight of the present invention with the body and head sections removed illustrating its internal components.

Referring to FIG. 2, a handheld searchlight 10 of the present invention showing the internal components is illustrated. The components fit inside the body 12 and head 14 sections that are not illustrated in FIG. 2. Lens 24 is normally secured to head 14 with threaded bezel 16. The threaded bezel 16, is also used to vary the optical characteristic of the light within the reflector 22, so that the beam spread can be changed. The illumination beam spread can be varied from flood mode to spot mode, or an intermediate beam spread as preferred by the particular application. The lamp 26 must be properly aligned within the reflector's 22 optical axis of symmetry as secured by lamp socket assembly 28. The lamp socket assembly 28 has springs 44 (see FIGS. 3*a-d*) that serve as floating electrical contacts to provide for proper alignment of the lamp 26.

In the illustrated embodiment, the lamp 26 is a xenon arc lamp, however the invention is expressly intended to include other kinds of incandescent or plasma lamps, including without limitation mercury-xenon, metal halide and halogen lamps. The plasma region within the lamp comprises a small, well-defined plasma ball where excited ions release energy in the form of photons. The lamp 26, with pin electrodes 46 and 47 is secured into lamp socket assembly 28 (FIGS. 3*a-d*). Additionally, the lamp 26 has a unique single-ended design wherein both the cathode 46 and the anode 47 (FIG. 3*d*) are secured on the same end of the lamp 26. The single-ended design allows for easier removal and replacement of lamps than if a lamp is secured on both ends. Ease of lamp 26 removal is necessary because it is envisioned that this may occur in the field and at night. The glass bulb surrounding the plasma region is also named the glass envelope. Importantly, the glass envelope should remain free of contamination from oil or dirt that may come from a user's fingers, especially due to the high operating temperatures attained by the lamp 26. As an alternative feature, the lamp may be encircled by a lamp protector (not shown). Also as an alternative feature, the lamp 26 may be removed and replaced using a lamp extraction tool (not shown) that is able to clamp onto the lamp 26, also to prevent contamination of the glass envelope.

Still referring to FIG. 2, the lamp socket assembly is electrically connected to a PCB 32 via spring contacts 44 (see FIGS. 3*a-d*). The PCB 32 contains circuitry for powering and controlling illumination produced by the lamp 26. Additionally, power converter circuits are contained on the PCB 26 to provide proper dc voltages for start up and sustained use. Also, the converter circuitry can provide the capability to power the handheld searchlight 10 from an external power ac source. Battery 36 is provided to power the handheld searchlight 10 for normal operation. The handheld searchlight 10 circuitry can also recharge the battery 36 from an external ac power source. Additionally, heatsink 34 is mounted on the PCB 32 to dissipate heat generated by the circuits. Heatsink 34 is effectively coupled to the housing body 12 to further increase thermal conductivity and improve heat transfer. The heatsink 34 is further designed so that external penetrations to the body 12 are not needed to provide sufficient contact for heat transfer. It is preferred that the heatsink 34 and body 12 are both made from extruded aluminum material for optimum heat transfer characteristics. It is also preferred that battery 36 comprises sliding contacts 39 to electrically connected it to the PCB 36. The sliding contacts 39 provide an inherent self-cleaning capability because the contacts 39 slide relative to their connections.

Figure 3A:
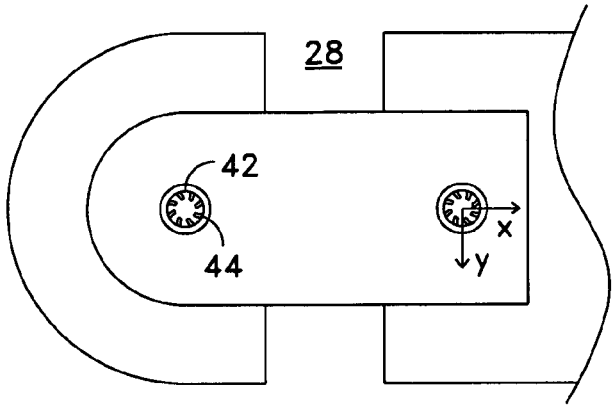
FIG. 3*a* is a sectional view taken along line 3-3 of FIG. 2, illustrating a lamp assembly system of the present invention.
Figure 3B:
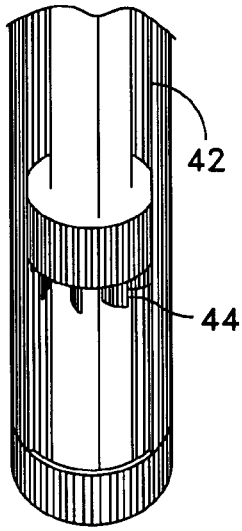
FIGS. 3*b* and 3*c* are partial cutaway isometric views of a lamp socket hole and pin electrode of the present invention.
Figure 3C:
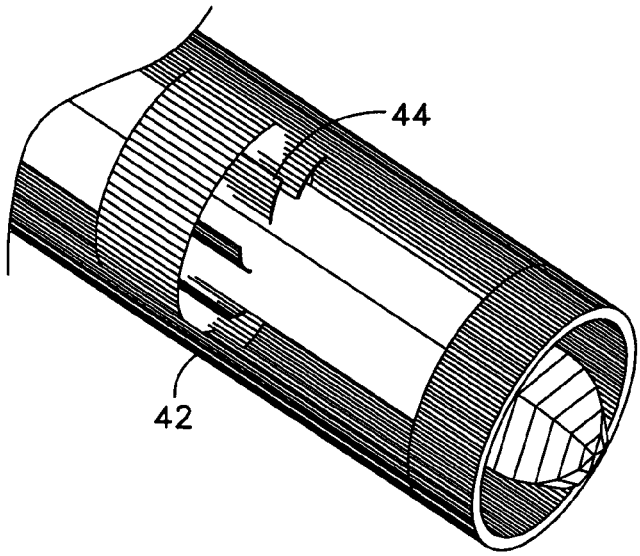
Figure 3D:
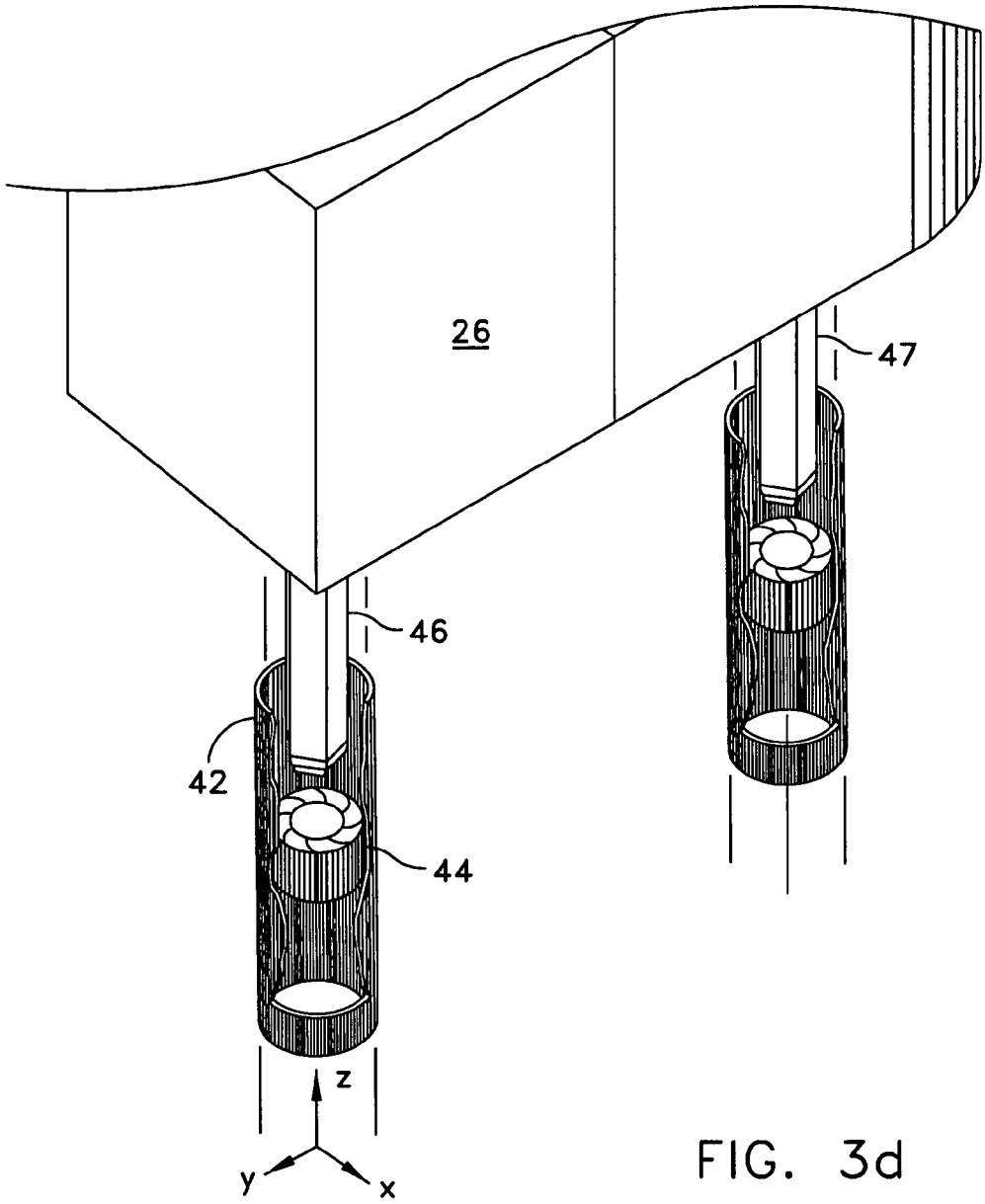
FIG. 3*d* is an enlarged perspective view of a lamp assembly system wherein the lamp is received by lamp socket holes.

Referring now to FIG. 3*a*, a partial cross-sectional view of the lamp socket assembly 28 taken along line 3*a* is shown. The assembly 28 contains two socket holes 42 to receive the lamp electrodes 46 and 47 (see FIG. 3*d*). A bulkhead 41 provides support for receiving the lamp 26. The bulkhead, however has openings in it to allow removal of the lamp 26 from the lamp socket hole 42. FIGS. 3*b* through 3*d* further illustrate how the pin electrodes 46 and 47 are received by the socket holes 42. The holes 42 contain spring contact assemblies 44 to provide proper alignment of the pin electrodes 46 and 47, and to provide an electrical interconnect between the lamp 26 and the PCB 36. Proper alignment will continually be affected by forces imparted by the reflector sleeve 22*a* (FIG. 2) on the lamp collar 26*a* during beam-spread adjustments. Therefore, spring contact assemblies 44 allow for circular movements in an X-Y plane to precisely align lamp 26 along reflector's 26 axis of optical symmetry.

Figure 4A:
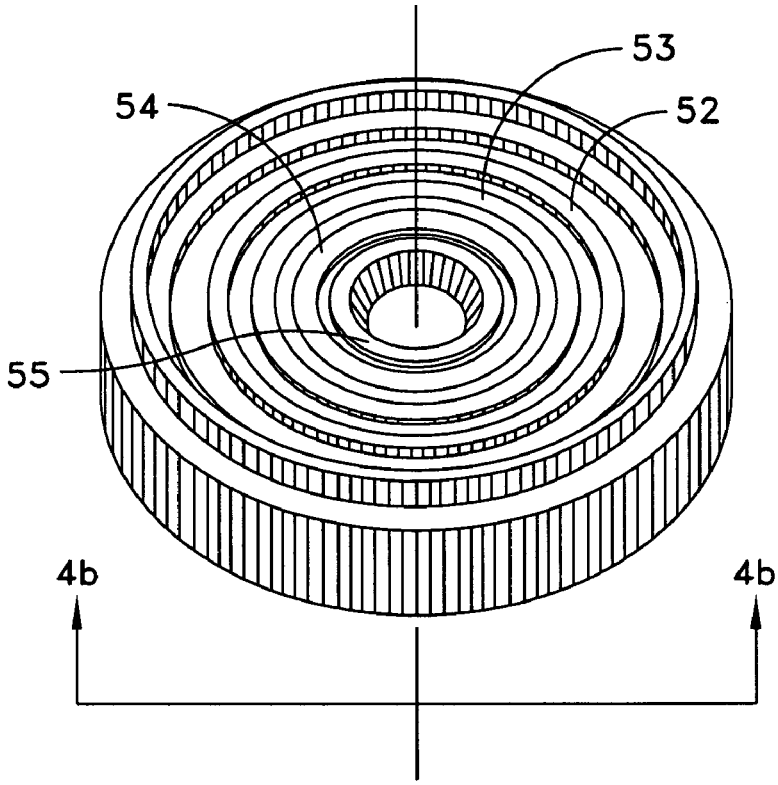
FIG. 4*a* is an isometric view of an end cap of the present invention.
Figure 4B:
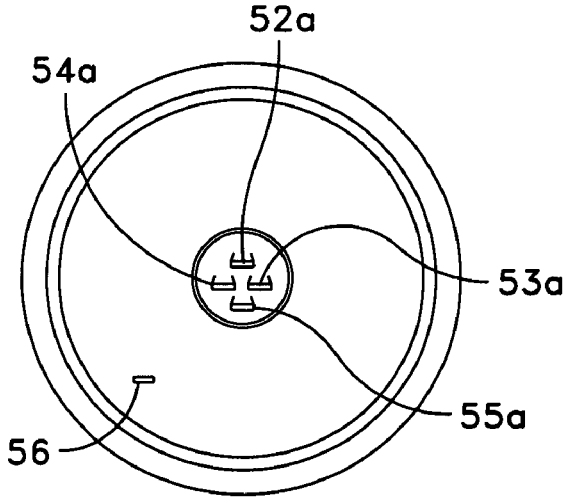
FIG. 4*b* is an end view of the end cap of the present invention.

Referring now to FIG. 4*a*, an enlarged view of end cap 17 is shown. Circular contacts 52-55 are provided to electrically interface the PCB 32 to an external power source. Two of the four contacts are positive and negative power terminals. A third contacts connects directly to LED 56 (FIG. 4*b*). Lastly, a fourth contact provides for remotely controlling ON/OFF power to the handheld searchlight 10. Remote control capability may be ideally preferred for military and covert applications where the light source does not revel the user's location.

The end cap 17 is threaded and may also have an o-ring (not shown) to improve watertight integrity. Also for watertight integrity, the end cap is able to be configured to receive external power through a watertight connector or inductive coupling, thereby eliminating an electrical penetration that would otherwise be needed. Inductive coupling could also be achieved through the body 12 of the present invention. Referring to FIG. 4*b*, connections 52*a*-55*a* correspond to circular contacts 52-55. LED 56 provides charging indication. According to the invention, LED 56 flashes while the battery is charging and LED 56 will go solid when the battery is fully charged.

Figure 5B:
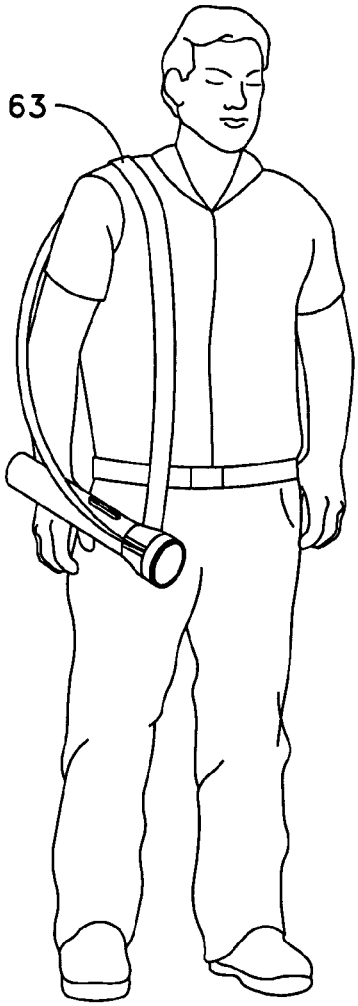
FIGS. 5*a* and 5*b* are a schematic illustrations of a shoulder strap of the present invention.
Figure 5A:
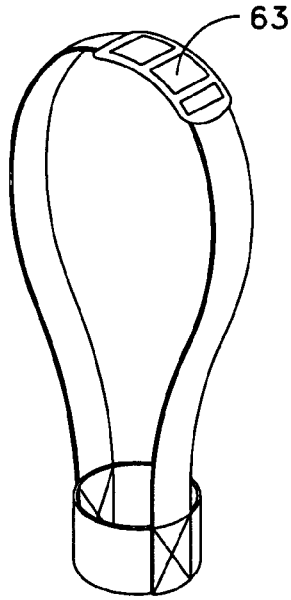

Referring to FIGS. 5*a* and 5*b*, a shoulder strap 63 of the present invention is illustrated that is provided for using and transporting the handheld searchlight 10. The strap 63 is designed to slip over the handheld searchlight where it is secured between the switch 15 and the head section 14. The weight of the handheld searchlight 10 is able to be supported by the strap 63 that should naturally extend along a user's 56 side. The strap 63 primarily provides support during transport and operation of the handheld searchlight 10.

Figure 6:
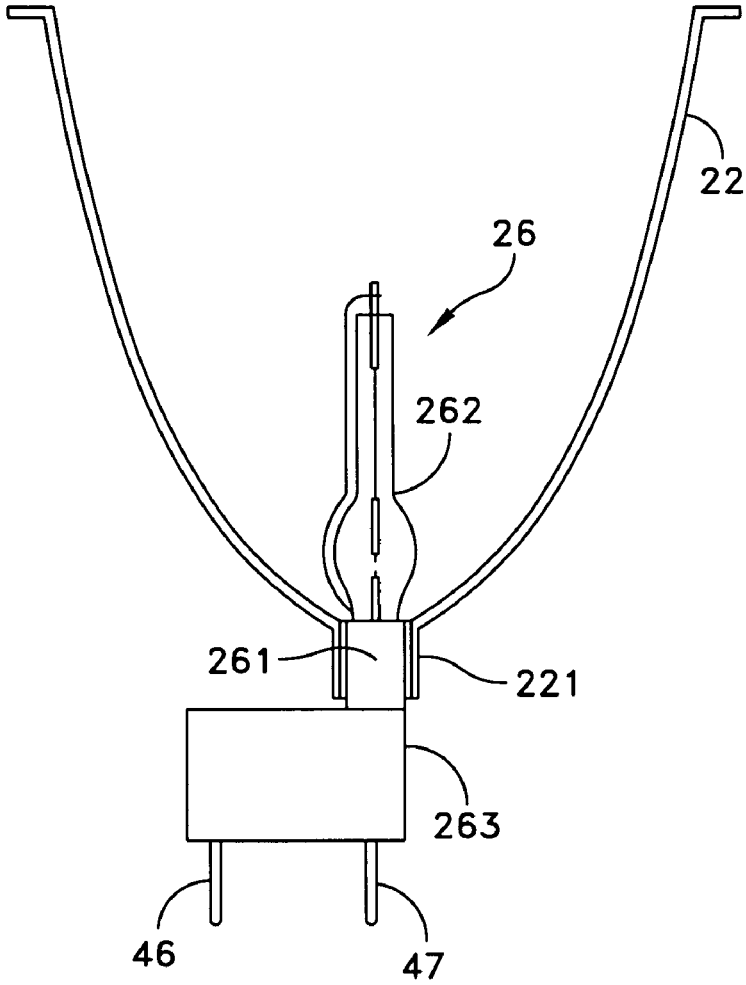
FIG. 6 is a side plane view of a lamp 26 of the present invention as configured with a sectional view of a reflector 22 of the present invention.

Finally, referring to FIG. 6, a side plane view of a lamp 26 of the present invention is shown, as configured with a sectional view of a reflector 22 of the present invention. The reflector 22 has a collar 221 disposed around a cylindrical neck portion 261. Importantly, the collar 221 and neck 261 are designed to maintain a close interface between the two so that the lamp 26 is maintained centered and aligned with respect to the optical access of symmetry 65. The close interface should also allow axial movement between the lamp 26 and reflector 22 while changing beam spread of the hand held searchlight. Additionally, the close interface is maintained so that it provides a path for heat transfer from the lamp 26 to the reflector 22. The reflector is coupled to the head section 14 to further dissipate heat generated in the lamp 26. By way of reference, the electrodes 46 and 47 extend from the base portion 263 of the lamp 26. FIG. 6 also illustrates the single-ended design of the lamp, allowing electrodes 46 and 47 to be physically located adjacent to one another rather than on opposing sides of the lamp 26. Glass envelope 262 is also illustrated.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

I claim:

1. A handheld searchlight having an elongated housing and a lamp for efficiently producing a high intensity beam of light output of the housing forward of the lamp, comprising: a printed circuit board within the housing and having a first surface and a second surface opposite said first surface, and including circuitry to regulate and control power supplied to the lamp; and a heat sink mounted onto a portion of said first surface of said circuit board, the heat sink also coupled to the housing at least rearward of the lamp to dissipate heat generated by the printed circuit board, wherein the lamp is one of an arc lamp, incandescent lamp, and plasma lamp.

2. The handheld searchlight of claim 1, wherein the heat sink is formed from extruded aluminum material.

3. The handheld searchlight of claim 1, wherein the housing is made from extruded aluminum material for optimum heat transfer characteristics.

4. The handheld searchlight of claim 1, further comprising a battery contained within the housing and electrically connected to the printed circuit board, wherein the battery supplies power to the handheld searchlight.

5. The handheld searchlight of claim 4 wherein the battery has a first end and a second end and one or more elongated sides, and wherein the battery has electrical contacts located alternatively on one of the first end or the second end or one of the elongated sides.

6. The handheld searchlight of claim 1 wherein the housing has a knurled surface to facilitate handling of the handheld searchlight by a user.

7. The handheld searchlight of claim 1, wherein the lamp is one of a mercury arc lamp, xenon arc lamp, metal halide arc lamp, and halogen arc lamp.

8. The searchlight of claim 1, further comprising a reflector disposed about the lamp to reflect light generated by the lamp.

9. A handheld searchlight having a lamp for efficiently producing a high intensity beam of light comprising: a printed circuit board having a first surface and a second surface opposite said first surface, and including circuitry to regulate and control power supplied to the lamp; a housing to contain the printed circuit board; and a heat sink mounted onto a portion of said first surface of said circuit board, the heat sink also coupled to the housing to dissipate heat generated by the printed circuit board, wherein the lamp is one of an arc lamp, incandescent lamp, and plasma lamp, further comprising a battery contained within the housing and electrically connected to the printed circuit board, wherein the battery supplies cower to the handheld searchlight wherein the battery has a first end and a second end and one or more elongated sides, and wherein the battery has electrical contacts located alternatively on one of the first end or the second end or one of the elongated sides, wherein the electrical contacts are sliding contacts.

10. A handheld searchlight having a lamp for efficiently producing a high intensity beam of light comprising: a printed circuit board having a first surface and a second surface opposite said first surface, and including circuitry to regulate and control power supplied to the lamp; a housing to contain the printed circuit board; a heat sink coupled to the printed circuit board, the heat sink also coupled to the housing to dissipate heat generated by the printed circuit board; a battery contained within the housing and electrically connected to the printed circuit board for supplying power to the handheld searchlight, the battery having a first end and a second end and one or more elongated sides, wherein the battery has sliding electrical contacts located alternatively on one of the first end or the second end or one of the elongated sides.

11. A handheld searchlight having an elongated housing and a lamp for efficiently producing a high intensity beam of light output of the housing forward of the lamp, comprising: a printed circuit board extending longitudinally within the housing and having a first surface and a second surface opposite said first surface, and including circuitry to regulate and control power supplied to the lamp; a heat sink mounted onto a portion of said first surface of said circuit board, the heat sink also coupled to the housing to dissipate heat generated by the printed circuit board, and a battery to furnish power electrically coupled to said printed circuit board and located intermediate said second surface of said printed circuit board and an interior surface of said housing, wherein the lamp is one of an arc lamp, incandescent lamp, and plasma lamp.

12. The searchlight of claim 11, wherein printed circuit board extends longitudinally rearward of the lamp and said heat sink is coupled to the housing rearward of the lamp.

* * * * *

UNITED STATES PATENT AND TRADEMARK OFFICE

CERTIFICATE OF CORRECTION

PATENT NO. : 7,344,268 B2
APPLICATION NO. : 10/614635
DATED : March 18, 2008
INVENTOR(S) : Gregory Z. Jigamian It is certified that error appears in the above-identified patent and that said Letters Patent is hereby corrected as shown below:

Col. 8, Claim 9, line 21 term "cower" should be changed to --power--

Signed and Sealed this

Seventeenth Day of June, 2008

JON W. DUDAS
*Director of the United States Patent and Trademark Office*